US005220116A

United States Patent [19]

Sheets

[11] Patent Number: 5,220,116

[45] Date of Patent: Jun. 15, 1993

[54] SHOOTING PLATFORM FOR QUADRIPLEGICS

[76] Inventor: John R. Sheets, 9555 W. Tams Dr., Baton Rouge, La. 70815

[21] Appl. No.: 884,954

[22] Filed: May 18, 1992

[51] Int. Cl.[5] ..... F41A 23/34

[52] U.S. Cl. ..... 42/94; 89/37.04; 89/37.11

[58] Field of Search ..... 42/94, 106; 89/37.04, 89/37.13, 37.11; 414/921

[56] References Cited

U.S. PATENT DOCUMENTS

| | | | |
|---|---|---|---|
| 882,988 | 3/1908 | Aloyos et al. | 89/37.04 |
| 1,337,359 | 4/1920 | Johnston | 42/94 |
| 2,731,829 | 1/1956 | Wiginton et al. | 73/167 |
| 3,827,172 | 8/1974 | Howe | 42/94 |
| 4,012,860 | 3/1977 | Auger | 42/94 |
| 4,333,385 | 6/1982 | Culver | 89/37.04 |
| 4,400,129 | 8/1983 | Eisenberg et al. | 414/921 |
| 4,759,684 | 7/1988 | Lanzillotta et al. | 414/921 |
| 4,802,612 | 2/1989 | Anderson | 224/208 |
| 4,841,839 | 6/1989 | Stuart | 89/37.04 |
| 4,937,965 | 7/1990 | Narvaez | 42/94 |
| 5,067,268 | 11/1991 | Ransom | 42/94 |
| 5,149,900 | 9/1992 | Buck | 42/94 |

FOREIGN PATENT DOCUMENTS

| | | | |
|---|---|---|---|
| 8201313 | 4/1982 | World Int. Prop. O. | 414/921 |

*Primary Examiner*—Stephen M. Johnson
*Attorney, Agent, or Firm*—Reginald F. Roberts, Jr.

[57] ABSTRACT

A shooting platform for quadriplegic. The platform has a frame for holding a rifle crossbow, or shotgun. The frame is mounted on a turntable which is rotatable by the quadriplegic seated in a wheelchair, using only the palm of a hand. The gun or crossbow is also aimed and fired by the quadriplegic, using only the palm of a hand.

15 Claims, 10 Drawing Sheets

SHOOTING PLATFORM FOR QUADRIPLEGICS

BACKGROUND OF THE INVENTION

The present invention relates to a device for aiming and firing a gun. More particularly, the invention relates to a device for assisting a quadriplegic to aim and fire a rifle, crossbow, or shotgun.

People suffering from quadriplegia experience total paralysis below the waist, and total or partial paralysis below the neck. If the paralysis is total, the quadriplegic cannot move the hands and arms. If the paralysis is only partial, the quadriplegic can move the arms, but cannot grip with the fingers.

The prior art includes devices for supporting, aiming, and firing guns by persons who are not handicapped. See, for example, U.S. Pat. Nos. 882,988: 2,731,829; 3,827,172; 4,012,860; 4,333,395; 4,841,839; and 5,067,268.

The prior art also includes a device designed for a handicapped user. U.S. Pat. No. 4,802,612 discloses a support device for sporting apparatus. The apparatus comprises a front support plate and a back support plate which are adjustably attached to each other with belts, so as to securely sandwich the wearer. An across-the-shoulder strap extending from the front support plate to the back support plate, and a bar extending outwardly and upwardly from the front support plate, for attaching a fishing rod holder, a gun rest, or a camera support are provided. A pivotal bar rod lock and a line-and-hook vise are also disclosed. A gun rest can be attached to the support device by a pivot or swivel arrangement, thereby enabling the user to move the gun laterally. However, a quadriplegic could not use this device as disclosed, because the gun rest does not include a frame for holding the gun; and because, if such a frame were provided, as disclosed e.g. by U.S. Pat. No. 882,988, 3,827,172, 4,012,860, or 4,333,385, the assembly would be too heavy and bulky to be attached to the body of the quadriplegic. Moreover, since a quadriplegic is unable to grasp an object, he or she would be unable to use any of the devices disclosed by these and other prior-art patents.

A need therefore exists for apparatus which a quadriplegic can use for target practice and/or hunting. The present invention provides such apparatus for partially-paralyzed quadriplegics who, while unable to use their fingers to grip an object, are able to move their arms and thereby their open hands.

SUMMARY OF THE INVENTION

In general, the present invention provides a shooting platform for enabling a quadriplegic seated in a wheelchair to aim and fire a rifle, crossbow, or shotgun. The shooting platform comprises a turntable on which is mounted a frame for holding the rifle, crossbow, or shotgun. Means for rotating the turntable, and for aiming and firing the rifle, crossbow, or shotgun are mounted on the turntable, and are constructed and arranged to respond to pressure exerted by an open hand of the quadriplegic seated in the wheelchair.

DETAILED DESCRIPTION OF THE INVENTION

Figure 1:
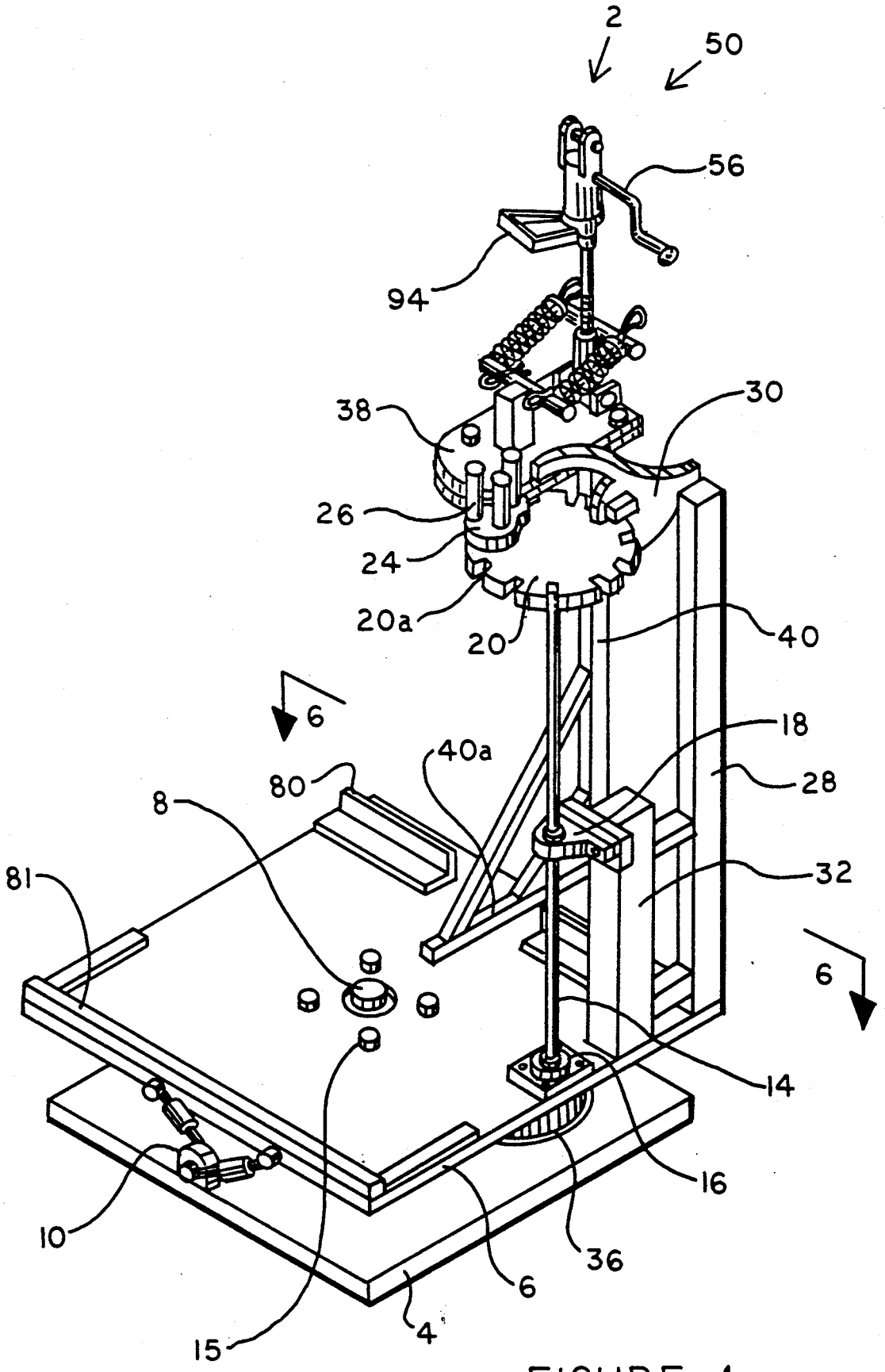
FIG. 1 is a schematic representation of a first embodiment of a shooting platform made in accordance with the principles of the present invention, as viewed from an oblique angle.
Figure 2:
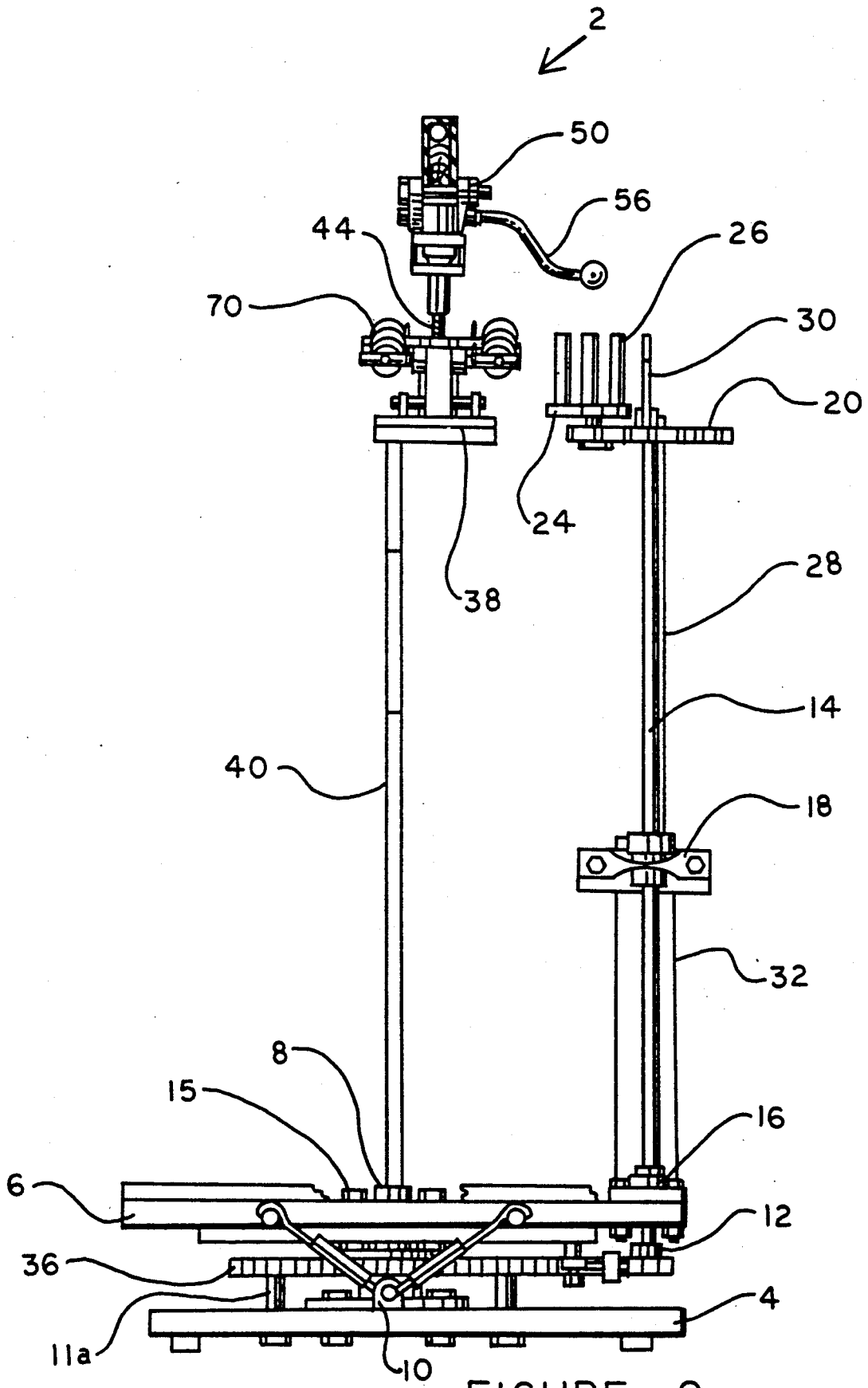
FIG. 2 is a front view of the platform shown in FIG. 1.
Figure 3:
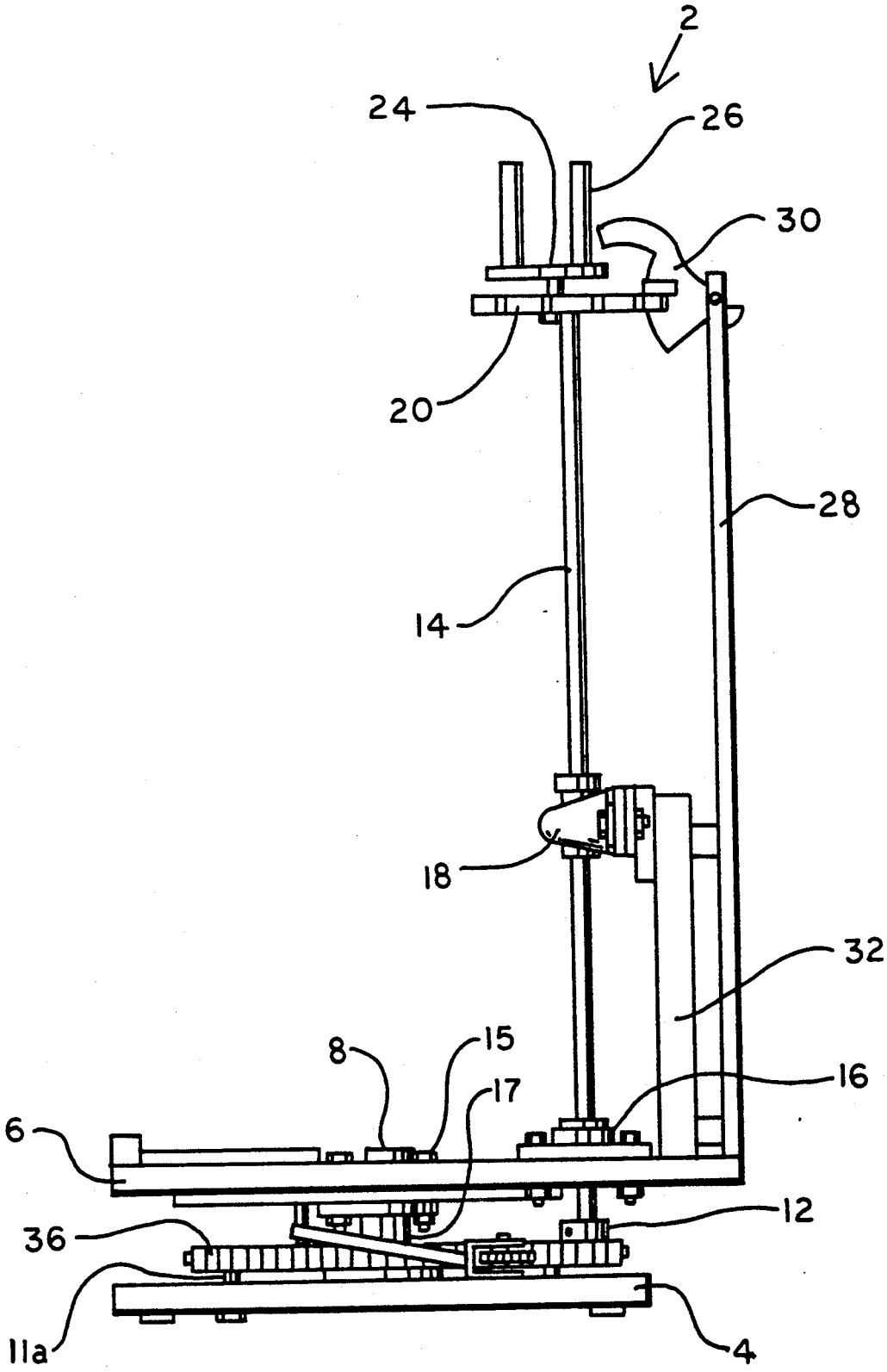
FIG. 3 is a side view of a portion of the platform shown in FIG. 1.

More specifically, reference is made to FIGS. 1–3, wherein is shown a first embodiment of a shooting platform made in accordance with the principles of the present invention, and generally designated by the numeral 2.

The shooting platform 2 comprises lower and upper first and second horizontal base plates 4 and 6, respectively. The upper second base plate 6 is mounted on and rotatably connected to the lower first base plate 4 by a roller bearing 8, which is disposed within a first sprocket 11 (FIG. 5) fastened to the first base plate 4 by sprocket mounts 11*a*. A second sprocket 12 (FIG. 5) is mounted to a first elongated vertical member 14 which extends upward through a plate bearing 16 disposed in the second base plate 6. Preferably, the first elongated vertical member 14 is a rod. Even more preferably, the rod 14 is a round rod. Extending farther upward, the rod 14 passes through a pillow-block bearing 18 to terminate at and be fastened to a first horizontal revolving plate 20 having notches 20*a* in the edge thereof. Fastened to the outer edge of the first revolving plate 20 for reciprocal rotation therewith is a second horizontal revolving plate 24 having at least three upstanding vertical studs 26 fastened to the upper surface thereof, for disposition of an open hand therebetween.

A second elongated vertical member 28 is mounted to the upper surface of the second base plate 6. Preferably, the second elongated vertical member is a bar. Even more preferably, the second elongated vertical member is a square bar. To the upper end of the bar 28 is mounted a brake 30 for locking the first revolving plate 20 in a desired position. The locking operation is effected by gravity insertion of the brake 30 in a particular notch 20*a* in the first revolving plate 20.

A third elongated vertical member 32, mounted on the second base plate 6 and disposed between and fastened to the rod 14 and to the bar 28, provides support for the rod 14 and first vertical bar 28. Preferably, the third elongated vertical member 32 is a bar. Even more preferably, the bar 32 is a square bar.

An idler sprocket 34 (FIG. 5) is mounted to the lower surface of the second base plate 6, between the first and second base plates 4 and 6.

Figure 5:
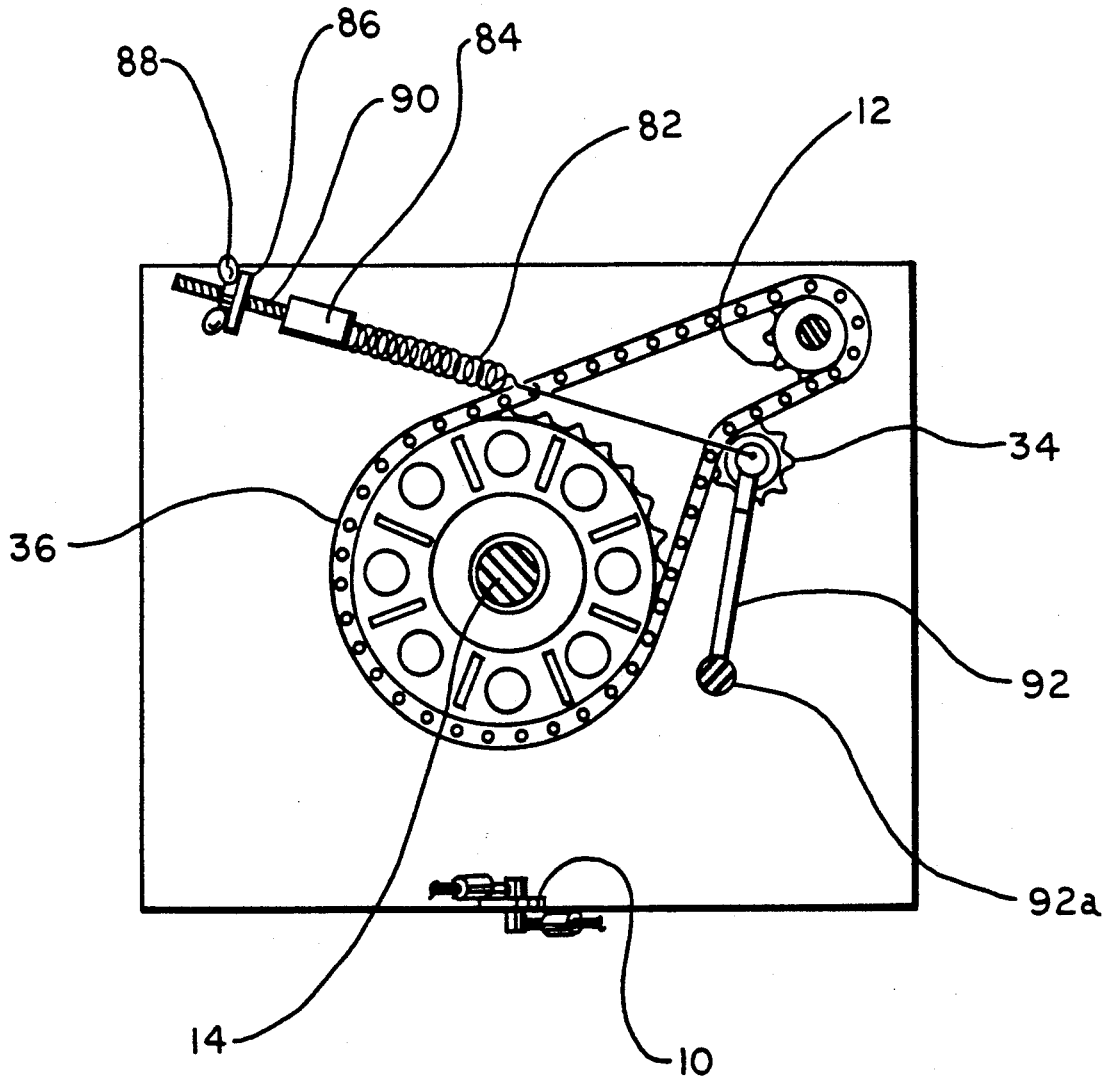
FIG. 5 is a top plan view of a portion of the platform shown in FIG. 1, showing certain features of the platform not shown in FIG. 1.
Figure 7:
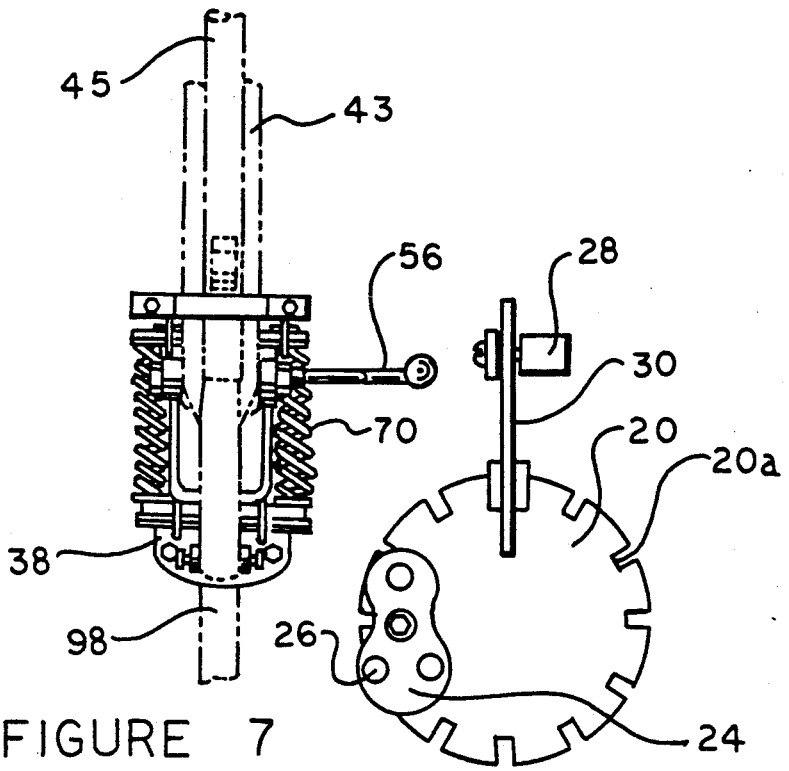
FIG. 7 is an enlarged view of portions of the platform shown in FIG. 1.
Figure 6:
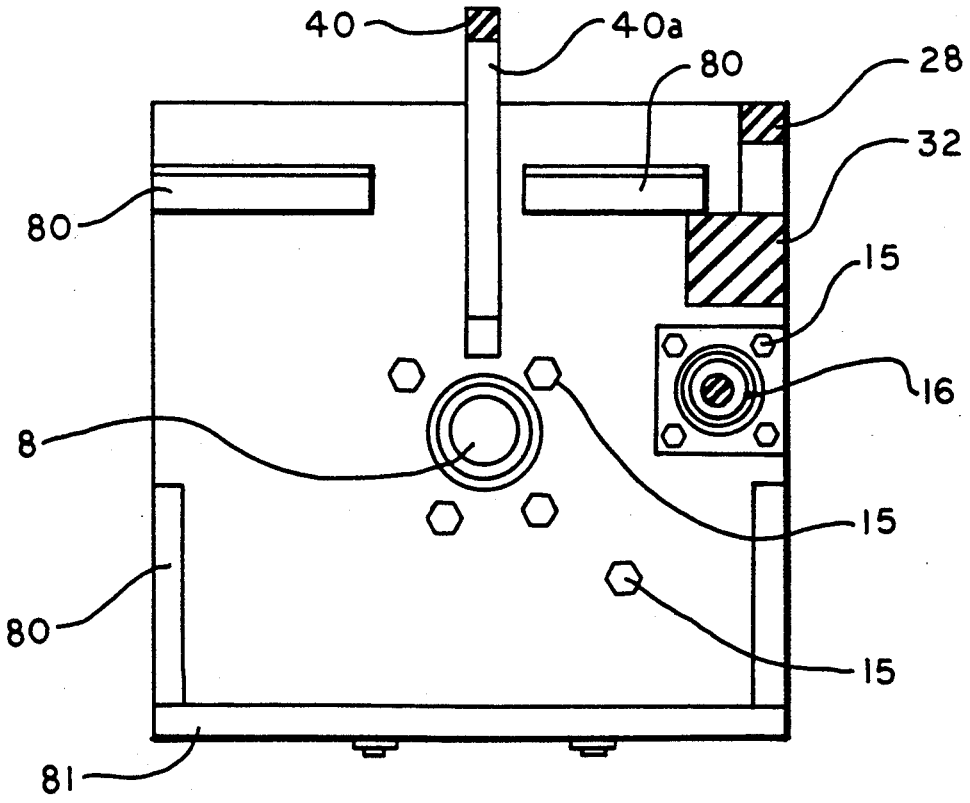
FIG. 6 is a cross-sectional view of the platform shown in FIG. 1, taken along the cutting line 6—6.
Figure 8:
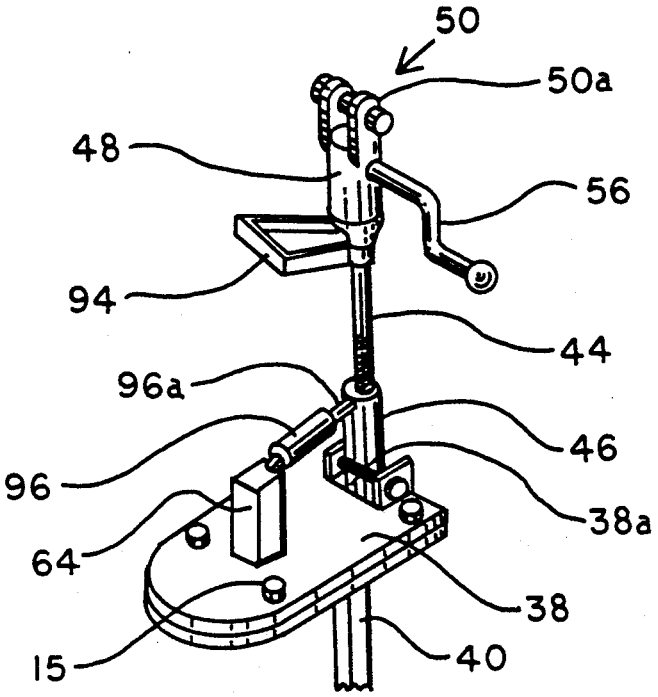
FIG. 8 is an enlarged view of a second embodiment of a portion of the platform shown in FIG. 1.
Figure 9:
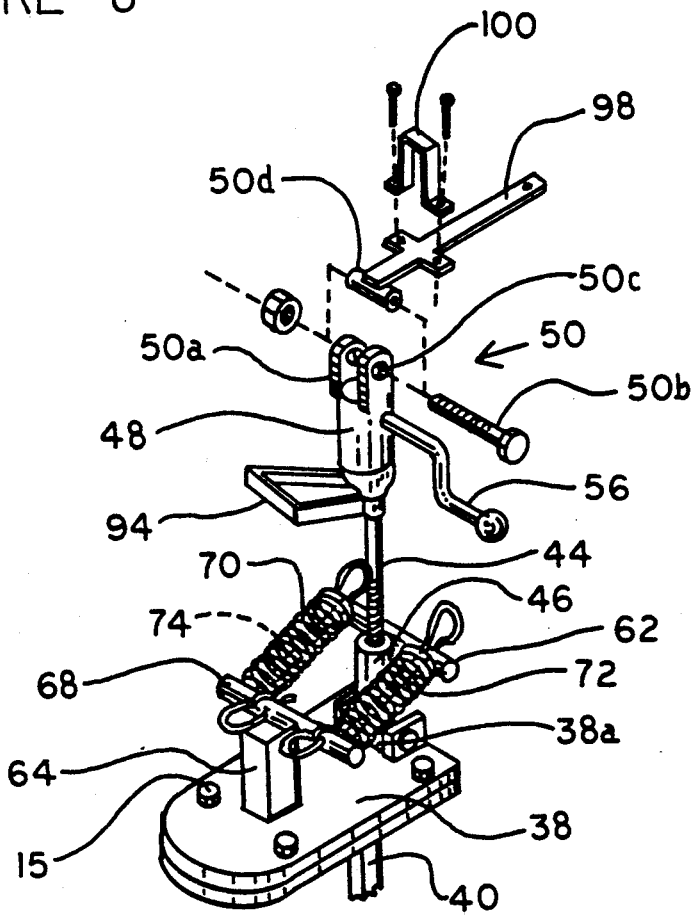
FIG. 9 is an enlarged exploded view of a portion of the platform shown in FIG. 1, showing certain features not shown in FIG. 1.

A chain 36 connects the first and second sprockets 11 and 12 to one another (FIG. 5). Tension on the chain 36 is effected by the idler sprocket 34. The first sprocket 11 is fixed; the second sprocket 12 rotates in response to the turning of the rod 14. Rotation of the rod 14 in either direction is effected by the turning of the first and second revolving plates 20 and 24. The first revolving plate 20, which is substantially larger than the second revolving plate 24, acts to provide a mechanical advantage in the turning of the plates 20 and 24. The second revolving plate 24 is turned in response to hand movement by the user's hand inserted between the studs 26. Thus the user, by turning the second revolving plate 24, can change the position of the second base plate 6 and thereby the orientation of the platform 2 as desired. The first base plate 4 provides a stable foundation for the platform 2. The first and second plates 4 and 6 are locked in the position shown in FIG. 1 by a turnbuckle 10, to stabilize the platform 2 while it is being transported from one location to another location.

A first support plate 38 is mounted on a fourth elongated vertical member 40 supported by the second base plate 6 (FIGS. 6–9). The fourth elongated vertical member 40 is preferably a bar, and even more preferably a square bar. A horizontal connecting member **40*a* is fastened to the second horizontal base plate 6 and to the fourth elongated vertical member 40**.

Figure 4:
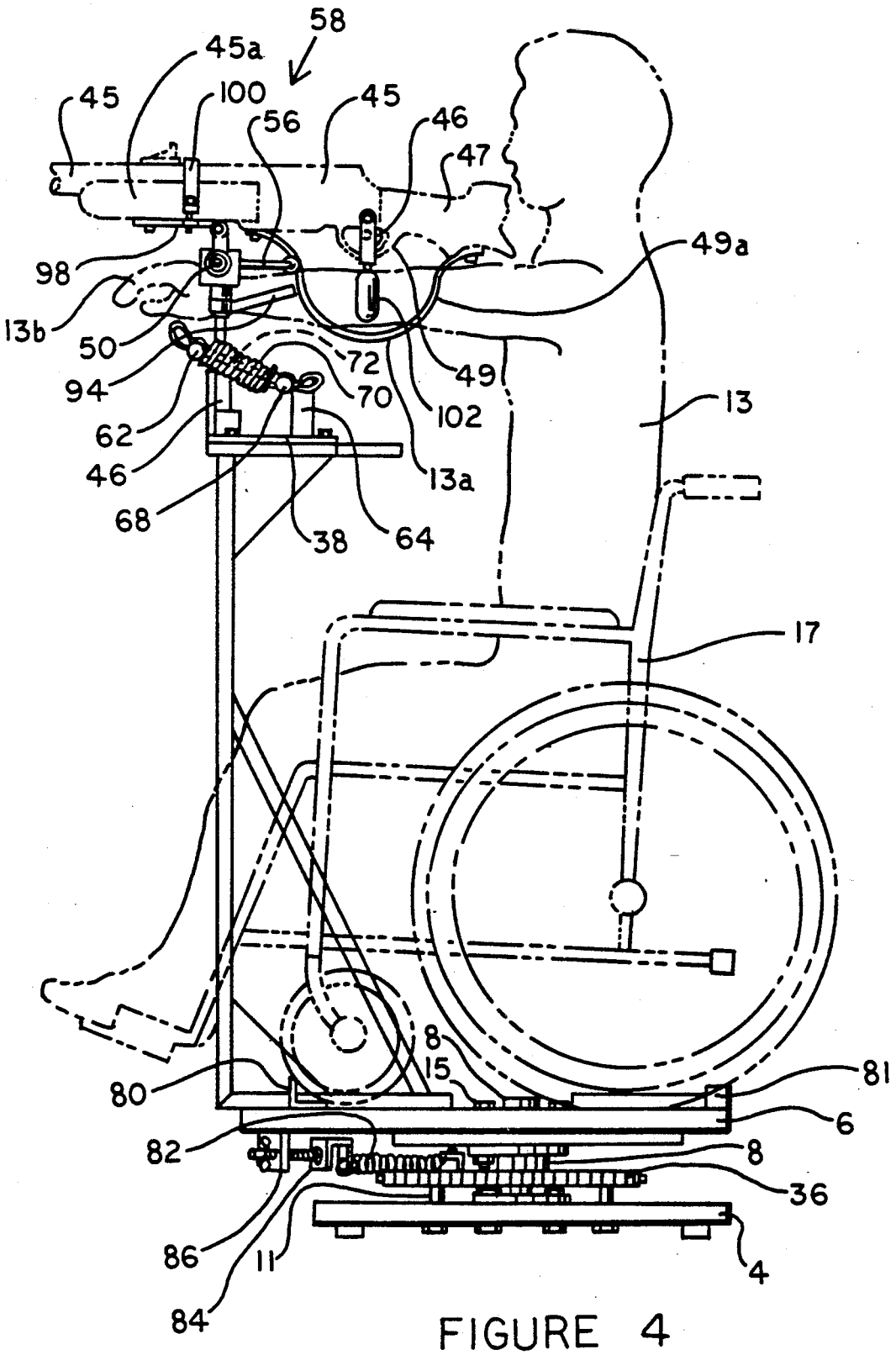
FIG. 4 is a side view of a portion of the platform shown in FIG. 1, showing a gun or crossbow, and a quadriplegic seated in a wheelchair.

A threaded sleeve 46 is movably disposed in a slot **38*a* of the first support plate 38, and a threaded rod 44 is disposed in and engages the threaded sleeve 46. An end of the threaded rod 44 is connected to a support bracket 94 and mounted to a gear box 48 provided with a crank 56. Mounted on the gear box 48 is a swivel 50, which includes arms 50*a* having therein openings 50*c*, a bushing 50*d*, and a bolt 50*b* disposed in the bushing 50*d* and the openings 50*c*. A second support plate 98 is fastened to the bushing 50*d*. The crank 56 enables the user to raise or lower the second support plate 98, which supports a crossbow 58 (FIG. 4). The support bracket 94 supports the a gun or crossbow 58 when the gun or crossbow is not in use. The gun or crossbow 58 may be fastened to the second support plate 98 by a bracket 100**.

In a first embodiment (FIG. 9), a first cross-member 62 is attached to the threaded sleeve 46. A second support member 64 is fastened perpendicularly to the first support plate 38. The first and second cross-members 62 and 68 are slidably and resiliently connected to one another by at least one spring and preferably by a pair of springs 70 in which are disposed a pair of bolts 72. The bolts 72 slide freely in holes 74 within the first cross-member 62. The shock-absorber against the recoil of the springs 70 act as a shock-absorber against the recoil of the gun 58 when the gun a crossbow is fired.

In a second embodiment (FIG. 8), the recoil of the gun or crossbow 58 is absorbed by a piston **96*a* slidably disposed in a cylinder 96 of a compressed gas. The preferred gas is air. The cylinder 96 and piston 96*a* are fastened to support member 64 and sleeve 46, respectively. The cylinder 96 and piston 96*a* resiliently connect the second support 64 and threaded sleeve 46 to one another by compression of the gas in response to the recoil of the gun or crossbow and movement of the threaded sleeve 46, and by decompression of the gas thereafter as the gun or crossbow 58 and the threaded sleeve 46** return to their initial positions.

Reference is now made to FIG. 4, in which is shown a quadriplegic individual 13 seated in a wheelchair 17 resting on the second base plate 6. The gun or crossbow 58, having a stock 47, forearm **45*a*, barrel 45, trigger 46, and trigger guard 49 is clamped to the second support plate 98 by the bracket 100. The quadriplegic 13 uses an arm 13*a* and a hand 13*b* to move a trigger-activator 102 connected to the trigger 46 by a roller pin (not shown), thereby firing the gun 58. The first support member 94 will provide additional support for the gun or crossbow 58 when the gun or crossbow is not in use. Aiming of the gun or crossbow 58 is effected by manipulation of the swivel 50 and crank 56**, using the open hand.

A second trigger guard **49*a* is fastened to the forearm 45*a* and stock 47, to prevent accidental activation of the trigger-activator 102**.

Figure 10:
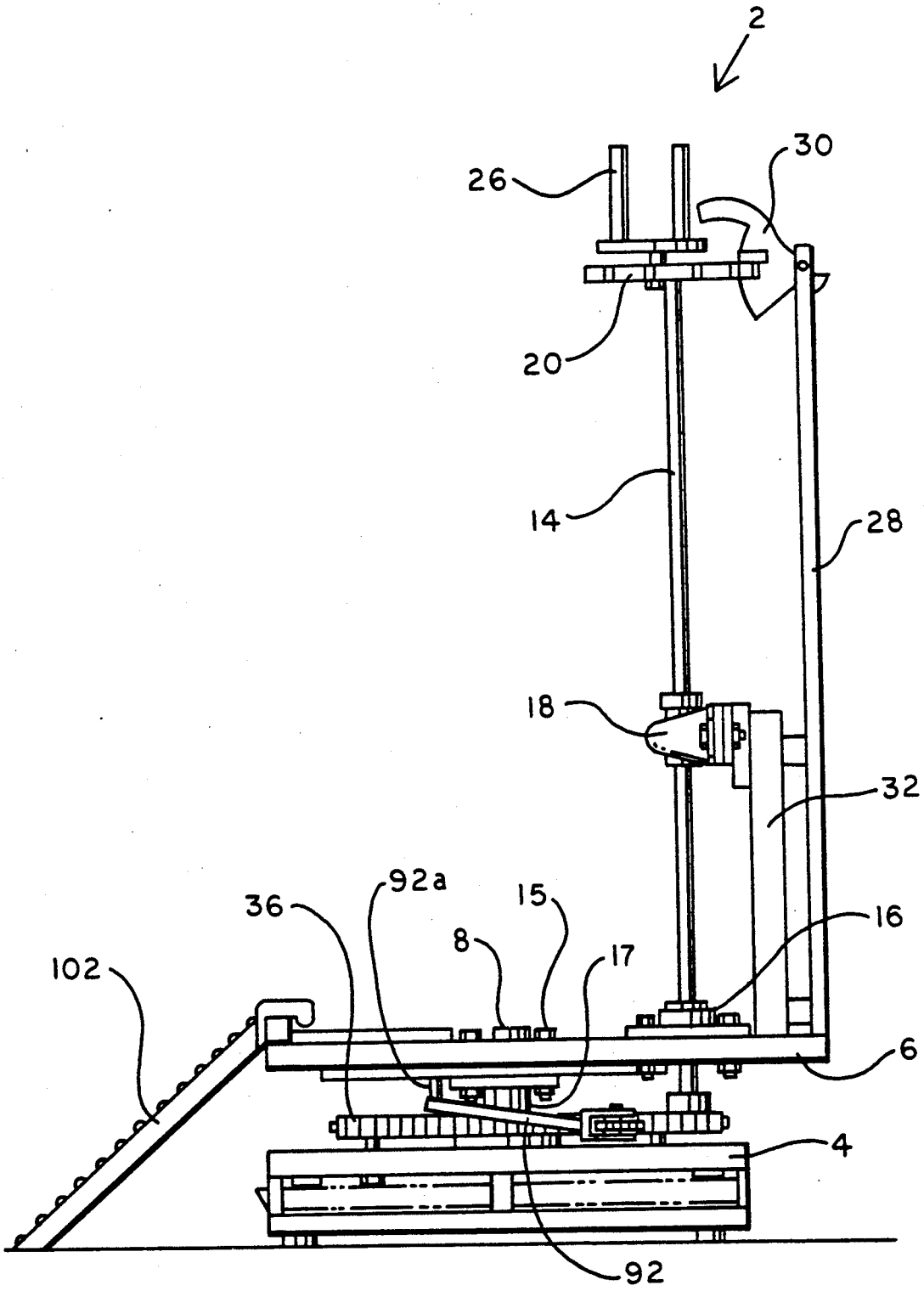
FIG. 10 is a side view of a portion of the platform shown in FIG. 3, showing a feature of the invention not shown in FIG. 3.

Reference is now made to FIG. 10, in which is shown a ramp 102 for loading the wheelchair 17 (FIG. 4) onto and off of the second base plate 6.

While the wheelchair 17 can be immobilized by a handbrake (not shown), wheelchair stops 80 and 81 (FIG. 4) are beneficially provided for locking the wheelchair 17 into a desired stationary position.

Reference is now made to FIG. 5, which shows a wingnut 88, plate 86, threaded rod 90, bracket 84, spring 82, and idler arm 92. As the wingnut 88 is turned against the plate 86, the threaded rod 90 is drawn in either direction, to tighten or loosen the spring 82, which thereby tightens or loosens the idler sprocket 34 supported by the idler arm 92. The idler arm 92 is in turn supported by a rod **92*a*. The foregoing procedure serves to adjust, i.e. tighten or loosen, the chain 36, while maintaining continuous tension on the chain 36 and sprockets 11 and 12**.

Figure 11:
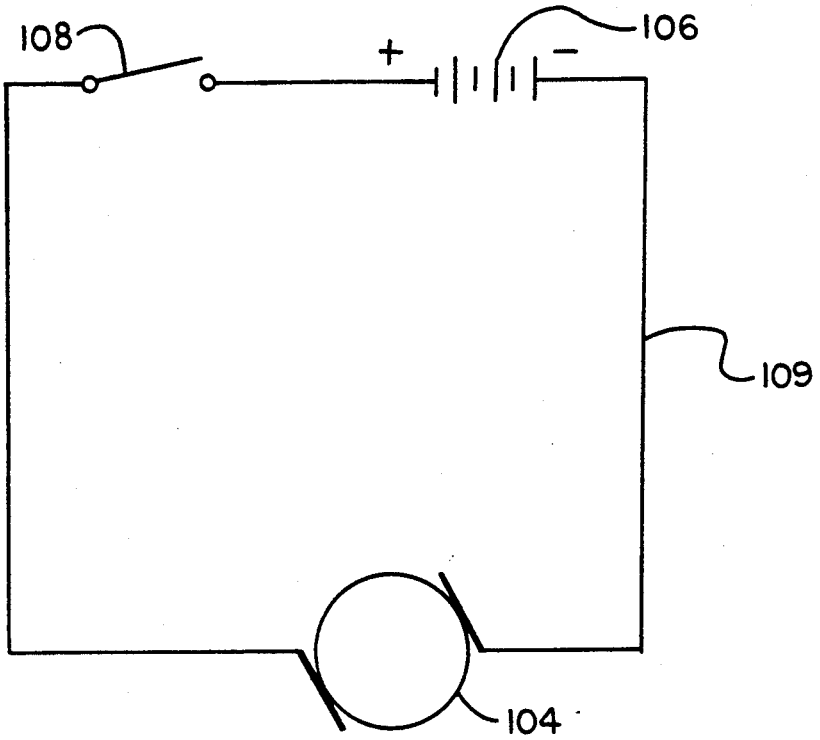
FIG. 11 is a wiring diagram for a second embodiment of a shooting platform made in accordance with the principles of the present invention.
Figure 12:
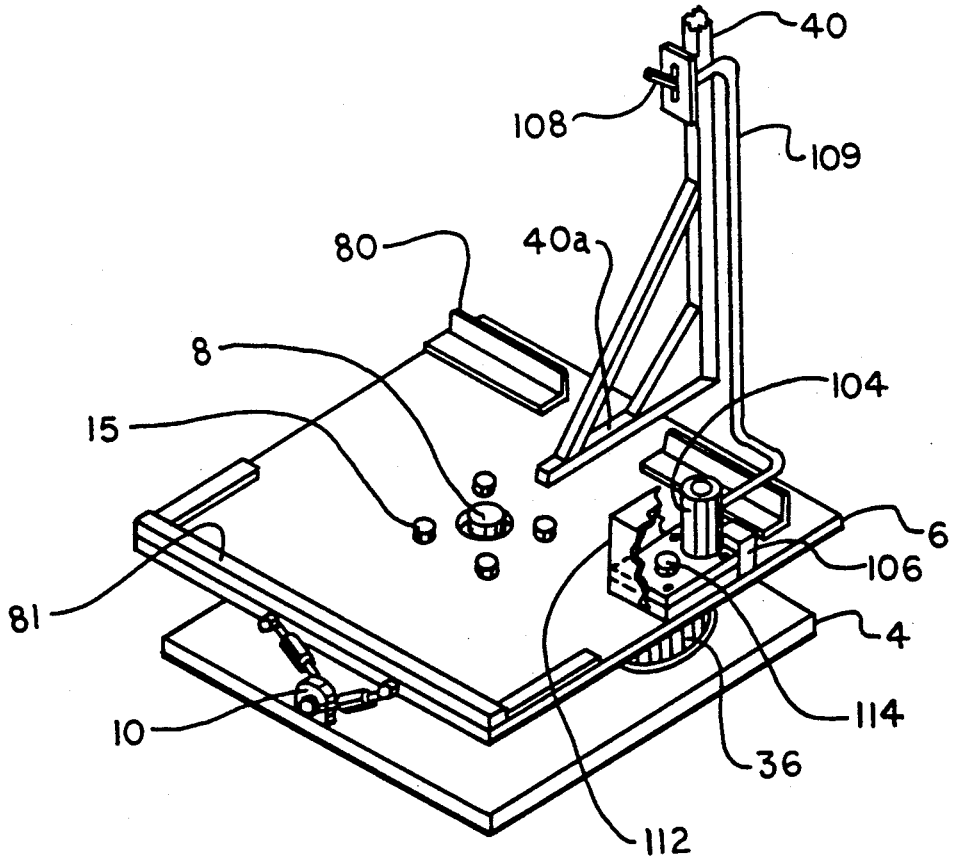
FIG. 12 is a schematic representation of a portion of a second embodiment of a shooting platform made in accordance with the principles of the present invention, as viewed from an oblique angle.
Figure 13:
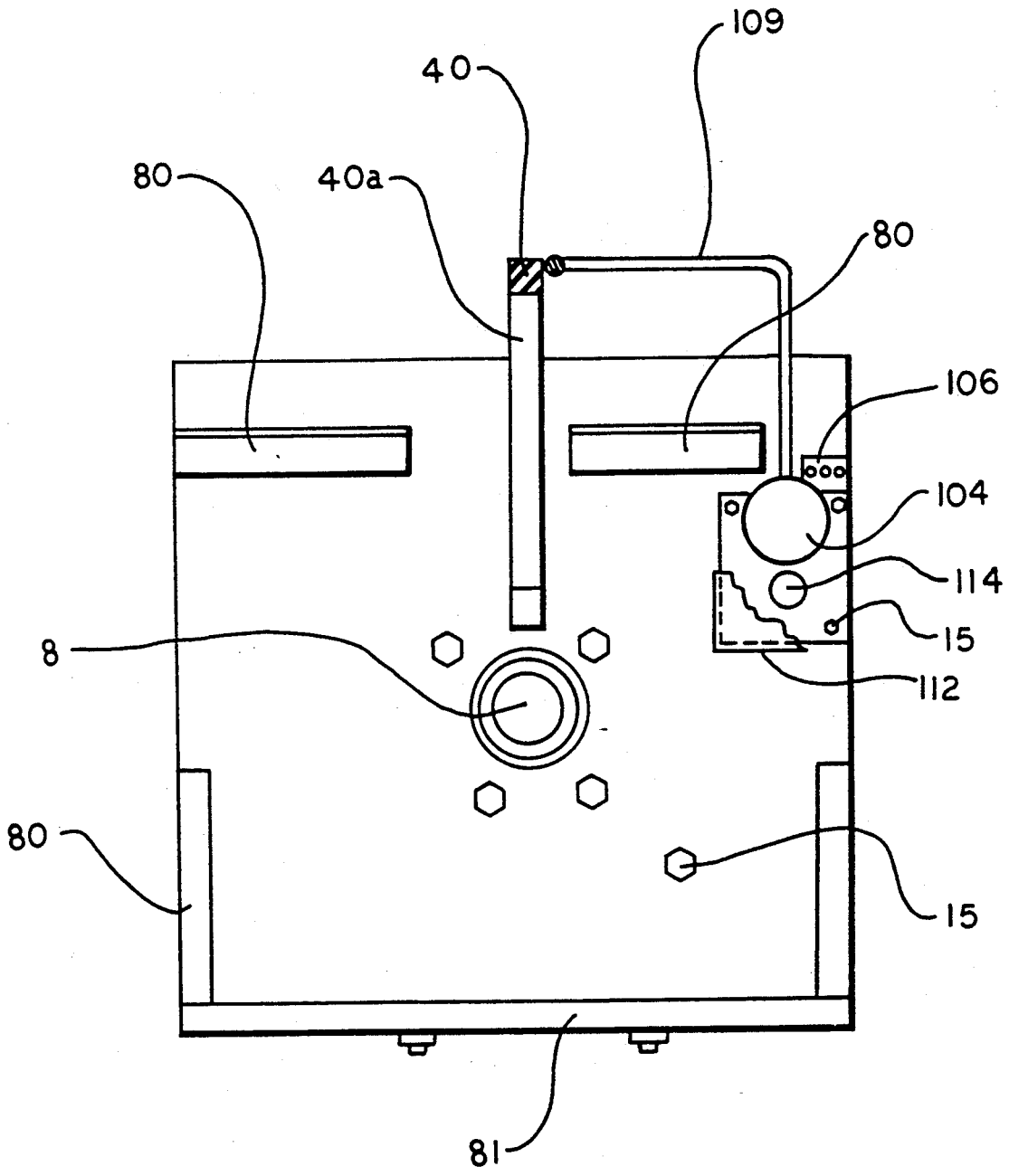
FIG. 13 is a cross-sectional view of the platform shown in FIG. 1, taken along the cutting line 13—13.

Reference is now made to FIGS. 11–13, in which is shown a second embodiment of a shooting platform made in accordance with the principles of the present invention. In this embodiment the turntable is rotated by a motor 104. More specifically, the upper second horizontal base plate 6 is rotated by an electric motor 104 powered by an electric battery 106. The electric motor 104 is turned on and off by an electrical switch 108 which is responsive to pressure from the palm or open hand of the quadriplegic. The motor 104 may beneficially be a reversible electric motor, whereby the base plate 6 may be rotated in either of two directions.

The electrical second embodiment of the present invention also includes a gear box 110, a housing 112 for the motor 104 and gear box 110, and a shaft 114 connecting the gear box 110 to the sprocket 36.

I claim:

1. A shooting platform for enabling a paraplegic seated in a wheelchair to aim and fire a gun or crossbow, the platform comprising:

(a) a turntable;

(b) a frame, mounted on and fastened to the turntable, for holding the gun or crossbow, (c) means for rotating the turntable, said means being constructed and arranged to respond to pressure exerted by an open hand of the quadriplegic seated in the wheelchair; and (d) means for aiming and firing the gun or crossbow, said means for aiming and firing being constructed and arranged to respond to pressure exerted by an open hand of the quadriplegic seated in the wheelchair.

2. The shooting platform of claim 1, further comprising:

(e) stop means, proximate the frame, and mounted on and fastened to the turntable, for immobilizing the wheelchair.

3. The shooting platform of claim 1, wherein the turntable includes:

($a_1$) a lower first horizontal base plate; and ($a_2$) an upper second horizontal base plate.

4. The shooting platform of claim 1, wherein the means for rotating the turntable include:

($c_1$) means for rotatably connecting the first and second horizontal base plates to one another;

($c_2$) a first horizontal revolving plate having notches in an outer edge thereof;

($c_3$) a second horizontal revolving plate having upper and lower surfaces, the second horizontal revolving plate being fastened to the outer edge of the first horizontal revolving plate for reciprocal rotation therewith;

($c_2$) at least three upstanding vertical studs fastened to the upper surface of the second horizontal revolving plate, for disposition therebetween of an open hand; and ($c_5$) means for connecting the first horizontal revolving plate to the means for rotatably connecting the first and second horizontal base plates to one another, the connecting means being constructed and arranged so that rotation of the first and second revolving plates causes rotation of the second base plate with respect to the first base plate.

5. The shooting platform of claim 4, further comprising:

(e) a brake insertable in the notches of the first horizontal revolving plate, for locking the first horizontal revolving plate and thereby the second horizontal base plate into a desired position.

6. The shooting platform of claim 1, wherein the frame includes:

($b_1$) an elongated vertical member supported by the second base plate;

($b_2$) a first support plate having upper and lower surfaces, the first support plate being mounted on the elongated vertical member;

($b_3$) a threaded sleeve movably disposed in a slot of the first support plate;

($b_4$) a threaded rod disposed in an engaging the threaded sleeve;

($b_5$) a support member fastened to the threaded sleeve;

($b_6$) a gear box connected to the threaded rod;

($b_7$) a swivel mounted on the gear box; and ($b_8$) a second swivel plate pivotally mounted to the swivel.

7. The shooting platform of claim 6, wherein the means for aiming the gun or crossbow include:

($d_1$) a crank engaging the gear box, for raising and lowering the threaded rod.

8. The shooting platform of claim 6, further comprising:

(e) means for absorbing the recoil of the gun or crossbow when the gun or crossbow is fire.

9. The shoot of claim 1, wherein the means for firing the gun or crossbow include:

($d_1$) a trigger-activator connected to the trigger, the trigger-activator being constructed and arranged to respond to pressure exerted by an open hand.

10. The shooting platform of claim 8, wherein the means for absorbing the recoil of the gun or crossbow include:

($e_1$) a first cross-member attached to the threaded sleeve;

($e_2$) a second support member fastened perpendicularly to the upper surface of the first support plate;

($e_3$) a second cross-member fastened to the second support member; and ($e_4$) a spring resiliently connecting the first and second cross-members.

11. The shooting platform of claim 8, wherein the means for absorbing the recoil of the gun or crossbow include:

($e_4$) a cylinder of a compressed gas; and ($e_5$) a piston slidably disposed in the cylinder; the cylinder and the piston resiliently connecting the second support member to the threaded sleeve by compression of the gas in response to the recoil of the gun or crossbow and movement of the threaded sleeve, and by decompression of the gas thereafter as the gun or crossbow and the threaded sleeve return to their initial positions.

12. The shooting platform of claim 4, wherein the first revolving plate is substantially larger than the second revolving plate, thereby providing a mechanical advantage in turning the first and second revolving plates.

13. The shooting platform of claim 1, further comprising:

(e) a ramp for loading the wheelchair onto and for unloading the wheelchair from the turntable.

14. The shooting platform of claim 1, wherein the means for rotating the turntable include a motor.

15. The shooting platform of claim 1, wherein the means for rotating the turntable include:

($c_1$) an electric motor;

($c_2$) an electric battery, for providing electrical power for the motor;

($c_3$) an electrical switch, for turning the and off; and ($c_4$) electrical cord connecting the motor, battery, and switch.

* * * * *